United States Patent [19]

Fujikake et al.

[11] Patent Number: 4,735,556

[45] Date of Patent: Apr. 5, 1988

[54] TURBOCHARGER

[75] Inventors: Kenji Fujikake, Nagoya; Masaaki Ochi, Aichi; Hiroshi Aoki, Nagoya, all of Japan

[73] Assignee: Kabushiki Kaisah Toyota Chuo Kenkyusho, Japan

[21] Appl. No.: 838,888

[22] Filed: Mar. 11, 1986

Related U.S. Application Data

[63] Continuation of Ser. No. 529,708, Sep. 6, 1963, abandoned.

[30] Foreign Application Priority Data

Sep. 10, 1982 [JP] Japan ..... 57-158609

[51] Int. Cl.[4] ..... F04B 17/00

[52] U.S. Cl. ..... 417/407; 165/904

[58] Field of Search ..... 417/405, 406, 407, 408, 417/409, 177; 165/DIG. 6

[56] References Cited

U.S. PATENT DOCUMENTS

| | | | |
|---|---|---|---|
| 2,822,974 | 2/1958 | Mueller | 417/407 |
| 2,891,879 | 6/1959 | Rohrer | 165/DIG. 6 |
| 2,914,915 | 12/1959 | Sziklas et al. | 165/DIG. 6 |
| 2,918,207 | 12/1959 | Moore | 417/407 |
| 2,973,136 | 2/1961 | Greenwald | 417/407 |
| 3,044,683 | 7/1962 | Woolenweber, Jr. | 417/323 |
| 3,205,937 | 9/1965 | Shyffer | 165/DIG. 6 |
| 4,101,241 | 7/1978 | Kasuya | 417/407 |
| 4,198,192 | 4/1980 | Webb | 417/407 |
| 4,249,386 | 2/1981 | Smith et al. | 60/655 |
| 4,256,441 | 3/1981 | Arora | 417/407 |
| 4,364,717 | 12/1982 | Schippers et al. | 417/407 |
| 4,427,309 | 1/1984 | Blake | 417/407 |

FOREIGN PATENT DOCUMENTS

| | | | |
|---|---|---|---|
| 3235538 | 3/1984 | Fed. Rep. of Germany | 417/407 |
| 39930 | 3/1984 | Japan | 417/407 |
| 2126663 | 3/1984 | United Kingdom | 417/407 |

OTHER PUBLICATIONS

Johnson, Alfred L. "Spacecraft Radiators", *Space/Aeronautics* Jan. 1962, pp. 76–84.

*Primary Examiner*—Carlton R. Croyle
*Assistant Examiner*—T. S. Thorpe
*Attorney, Agent, or Firm*—Berman, Aisenberg & Platt

[57] ABSTRACT

A turbocharger of the present invention is provided with a thermo-reducing means between the turbine housing and the bearing housing in order to reduce the heat transferred from the turbine housing to the bearing housing. The thermo-reducing means comprises a thermo-isolating means such as an annular member made of a low heat conductive material. Also, the annular member contacts with the wall of the turbine housing which has a high thermal resistance, so that the heat transferred from the turbine housing to the connecting portion is reduced. The thermo-reducing means also comprises a sensible heat reducing means which is composed of a layer made of a low conductive material, on the inner surface of the wall of the turbine housing, preventing the heat transferred from the exhaust gas to the wall, and a layer made of a high emissive material, on the outer surface of the wall of the turbine housing radiating out the heat effectively. The turbine housing of the sensible heat means has the lower heat capacity compared with that of the bearing housing to reduce the sensible heat of the turbine housing.

20 Claims, 2 Drawing Sheets

TURBOCHARGER

This is a continuation of Ser. No. 529,708 filed Sept. 6, 1983, now abandoned.

BACKGROUND OF THE INVENTION

1. Field of The Invention

This invention relates to an improvement of a turbocharger used in an internal combustion engine for automobiles and other uses.

2. Description of The Prior Art

In general, a turbocharger comprises a turbine rotor, a bearing housing which supports a shaft of the turbine rotor, a turbine housing which receives a turbine of the turbine rotor and is fixed to one end of the bearing housing and a compressor which is mounted on the other end of the bearing housing. The turbine, which is driven by the pressure of exhaust has from an engine, rotates a compressor, which compresses intake air and feeds it into a cylinder of the engine.

Usually, a turbocharger is lubricated and cooled by virtue of a lubricating oil of an engine. Therefore, no problem will occur in lubrication and cooling of a bearing housing during engine operation, since the lubricating oil is supplied to the bearing housing by the action of an oil pump of the engine.

However, when the engine is stopped, the oil pump will stop and supply no lubricating oil. This leads to a remarkable reduction of the cooling performance of the oil. Especially, after a high load operation, the turbine housing may have reached a very high temperature and therefore, without cooling by the lubricating oil, the bearing housing is heated by heat conduction from the turbine housing and sometimes takes a temperature higher than 300° C. in several minutes after engine stoppage.

Such high temperature may carbonize the lubricating oil in the bearing housing and cause degradation of the oil. The oil carbonization may also deteriorate the bearing and reduce the performance of the turbocharger. In the worst cases, the turbocharger may be fractured.

Conventional preventive measures against these problems include prevention of sudden stop of an engine which has been operated at a high load and continuation of idling operation for a certain period in accordance with a previous engine load. However, these conventional measures are taken at an operator's will and therefore are not completely practiced.

SUMMARY OF THE INVENTION

A primary object of the present invention is to provide a turbocharger with little degradation of lubricating oil in a bearing housing without any particular procedure such as idling operation, in order to overcome the above noted problems.

Another object of the present invention is to provide a turbocharger which can prevent temperature rise of lubricating oil due to heat transfer from the bearing housing at engine stoppage.

Still another object of the present invention is to provide a turbocharger which can reduce heat transfer from the turbine housing to the bearing housing.

A further object of the present invention is to provide a turbocharger which can prevent heat transfer from the turbine housing to the bearing housing.

Another object of the present invention is to provide a turbocharger which can reduce sensible heat of the turbine housing.

In this description, a turbocharger comprises a turbine rotor, a bearing housing which supports the shaft of the turbine rotor, a turbine housing which receives the turbine of the turbine rotor and is fixed to one end of the bearing housing and a compressor which is mounted on the other end of the bearing housing; the bearing housing and the turbine housing are fabricated separately.

The turbocharger according to the present invention is mainly used as an exhaust turbo-supercharger for automotive use. However, the present invention is not to be limited thereto but is applicable to all the turbo machineries which have the construction described above.

The turbocharger according to the present invention comprises a turbine rotor, a bearing housing which supports a shaft of the turbine rotor, a turbine housing which receives the turbine of the turbine rotor and is fixed to one end of the bearing housing, a compressor which is mounted on the other end of the bearing housing, and thermo-reducing means which can reduce heat transferred from the wall of the turbine housing to the wall of the bearing housing.

The turbocharger according to the present invention has a means of reducing the heat transferred to the bearing housing, so is one which can reduce degradation of lubricating oil in the bearing housing without special operation such as idling operation.

The present invention includes the following aspects when it is put into practice.

According to a first aspect of the present invention, the thermo-reducing means is composed of a thermo-isolating means which prevents heat transfer from the wall of the turbing housing to the wall of the housing.

This turbocharger can reduce heat transfer to the bearing housing using said thermo-isolating means which prevents heat transfer at the heat transfer parts of the turbine housing which acts as a heat source, and of the bearing housing with aforementioned thermo-isolating means.

According to a second aspect of the present invention, the thermo-reducing means is sensible heat reducing means which reduces the sensible heat of the turbine housing which is a heat source being transferred into the wall of the bearing housing.

The turbocharger can thus reduce the heat transferred form the turbine housing to the bearing housing by reducing the sensible heat of the turbine housing which is a heat source.

According to a third aspect of the present invention, the thermo-isolating means is composed of an annular shaped member made of low heat conductive material interposed between the wall of the bearing housing and the wall of the turbine housing.

This turbocharger can prevent the heat transferred from the turbine housing of the turbo machine to the bearing housing by interposing a low heat conductive member, thereby the temperature rise of the bearing housing is suppressed.

The heat transferred from the turbine housing to the bearing housing becomes remarkably less, therefore, if an engine being operated at a high load is suddenly stopped, and even if not followed by idling operation, the bearing housing is prevented from being excessively heated by the heat from the turbine housing, accordingly, degradation of the lubricating oil in the bearing housing can be suppressed.

According to a fourth aspect of the present invention, said thermo-isolating means is composed of a forced cooling means which is mounted at a connecting part between the wall of the bearing housing and wall of the turbine housing or at the place adjacent there and cools that part forcibly.

This turbocharger can prevent the heat transferred from the turbine housing of the turbo machine to the bearing housing, or at the same time, increasing heat radiation of the bearing housing by mounting a means which cools forcibly the connecting part between the bearing housing and the turbine housing or the part of the bearing housing adjacent there, accordingly, capable of supressing the temperature rise of the bearing housing.

The invention can reduce the heat transferred to the lubricating oil in the bearing housing, and can prevent degradation of the oil.

According to a fifth aspect of the present invention, the sensible heat reducing means is composed of a layer made of a low conductive material mounted on the inner wall surface of said turbine housing in contact with exhaust gas.

Sensible heat is expressed by the product of temperature and heat capacity. As for the turbocharger according to the fifth aspect, taking notice at temperature of sensible heat, for the purpose of reducing the temperature of the turbine housing, a layer of low conductivity is mounted on the inner wall of the turbine housing, thereby thermo-isolation of the wall of the turbine housing from the exhaust gas is to be obtained.

As for this turbocharger, by mounting a low heat conductive layer on the surface of the turbine housing which contacts with exhaust gas, the heat transfer from the high temperature gas passing through the turbine housing to the turbine housing is reduced, thereby the temperature rise of the turbine housing can be supressed.

The heat capacity transferred from the turbine housing to the bearing housing is therefore reduced, the temperature rise of the bearing housing can be supressed as much, accordingly, degradation of the lubricating oil can be prevented.

According to a sixth aspect of the present invention, said sensible heat reducing means is composed of a layer made of a high emissive material mounted on the outer periphery surface of the turbine housing. Sensible heat is expressed by the product of temperature and heat capacity. As for this turbocharger according to the sixth aspect, taking notice of temperature of sensible heat, for the purpose of reducing the temperature of the turbine housing, a layer of high emissivity is mounted on the outer periphery surface of the turbine housing to increase the heat radiation from the outer wall of the turbine housing, thereby the temperature of the turbine housing is reduced.

This turbocharger is a turbo machine capable of increasing heat radiation of the turbine housing by mounting a high emissive layer on the outer periphery surface of the turbine housing in no contact with exhaust gas, and capable of surpressing the temperature rise of the turbine housing by making the heat of the wall of the turbine housing radiate effectively.

According to a seventh aspect of the present invention, the sensible heat reducing means is composed of a turbine housing itself which has adequately less heat capacity than that of the bearing housing, thereby the sensible heat of the turbine housing can be reduced.

Sensible heat is expressed by the product of temperature and heat capacity. As for the turbocharger according to the seventh aspect, taking notice of heat capacity of sensible heat, the heat capacity of the turbine housing is reduced.

In this turbocharger, the heat capacity of the turbine housing is a small value comparted with the heat capacity of the bearing housing, thereby the total sensible heat of the turbine housing is reduced and the temperature rise of the bearing housing can be supressed under a specified temperature.

BRIEF DESCRIPTION OF THE DRAWINGS

The preferred embodiments of the invention will now be described by way of example with reference to the accompanying diagrammatic drawings in which:

FIG. 6 is a side elevation of the turbocharger and FIG. 7 is a cross-sectional view along A—A line in FIG. 6.

DETAILED DESCRIPTION OF THE INVENTION

Figure 1:
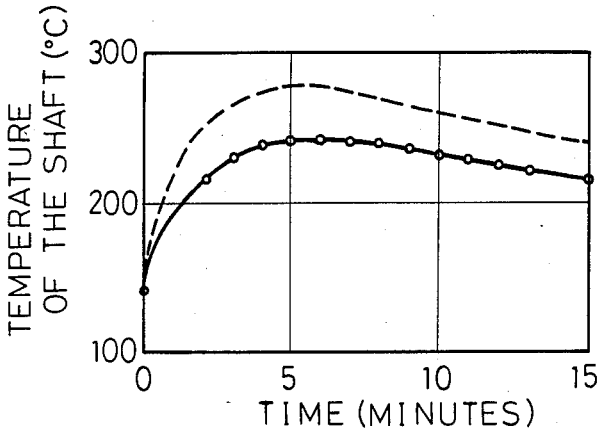
FIG. 1 is a diagram showing the relationship between elapsed time and temperature rise of a bearing after an engine has been stopped in a conventional turbocharger and in a turbocharger with a low heat conductive part according to the first embodiment of the present invention.

The thermo-reducing means of the turbocharger according to the present invention can reduce the heat transferred from the wall of the turbine housing to the wall of the bearing housing.

This thermo-reducing means comprises a thermo-isolating means capable of preventing the transfer of heat from the wall of the turbine housing to the wall of the bearing housing and/or a sensible heat reducing means capable of reducing the sensible heat of the turbine housing which can be transferred to the wall of the bearing housing.

The thermo-isolating means is composed of an annular shaped member made of a low-heat conductive material interposed between the wall of the bearing housing and the wall of the turbine housing and/or a forced cooling means which is mounted on a connecting part between the wall of the bearing housing and the wall of the turbine housing or its vicinity, and capable of preventing the heat transferred from the turbine housing to the bearing housing by means of cooling the part forcibly.

A sensible heat reducing means comprises a temperature reducing means for reducing the temperature of the turbine housing, a source of the heat, and/or a heat capacity reducing means reducing the heat capacity of the said turbine housing.

Since sensible heat is expressed by the product of temperature and heat capacity, this means can be roughly classified as follows: means for reducing the temperature of the turbine housing by means of heat insulation or heat radiation of the turbine housing, and means for reducing the heat capacity at early stage of engine stoppage, consequently reducing the sensible heat transferred to the bearing housing.

Here, as for the temperature reducing means, the following two ways are taken; one in which a covering layer made of low heat conductive material is mounted on the inner wall surface of the turbine housing in contact with exhaust gas to reduce the heat transfer to the inner wall of the turbine housing, and another in which a covering layer made of highly emissive material is mounted to radiate the heat of the wall of the turbine housing effectively.

The turbocharger according to one aspect of the present invention has a low heat conductive member with a heat conductivity resistance not less than 0.001 $m^2h°C./Kcal$, which intervenes between a bearing housing and a turbine housing of the turbocharger, in order to prevent heat transfer from the turbine housing and thus suppress the temperature rise of the bearing housing.

This low heat conductive member preferably has a heat resistance up to temperatures of at least 700° C. and a heat conductivity resistance not less than 0.001 $m^2$ h°C./Kcal. For the above noted purpose are usable such materials as ceramic sheets made by lamination of intercalated minerals such as mica, vermiculite and graphite and fibers, sheets made by compression, weaving, or suitable ordering of glass and other ceramic fibers such as zirconia fiber.

The heat transferred from the turbine housing to the bearing housing is remarkably reduced when such material as noted above is interposed between the turbine housing and the bearing housing. Therefore, if an engine operated at a high load is suddenly stopped, even if not followed by idling operation, the bearing housing is prevented from being excessively heated by the heat from the turbine housing.

FIG. 1 shows a typical temperature rise of a bearing housing with the lapse of time after engine stoppage for the case when the temperature of a turbine housing is 600° C. at engine stoppage. In this case, the temperature of the bearing housing is measured at the bearing support for the rotor shaft on the turbine side. The dashed line in FIG. 1 shows the temperature rise in a conventional turbocharger, wherein no low heat conductive member intervenes between a rotor housing and a bearing housing. The solid line in FIG. 1 shows the temperature rise in a turbocharger according to the present invention, wherein a zirconia fiber sheet with a thickness of 1 mm intervenes between a turbine housing and a bearing housing. As clearly shown from FIG. 1, interposition of a member with a low heat conductivity reduces the temperature of the shaft of the bearing housing to about 240° C., i.e. 30° C. lower than that of the shaft of a conventional turbocharger.

Further, in the interposition of a low heat conductive member, it is preferred to cover the entire surface of a bearing housing which is faced to a turbine housing.

It is also preferred to interpose the annular member between a projected portion of thin thickness or small sectional area which constitutes the connecting part of the bearing housing and a caved portion which constitutes the connecting part of the turbine housing, or between a projected portion of thin thickness or small sectional area which constitutes the connecting part of the turbine housing and a caved portion which constitutes the connecting portion of the bearing housing.

And also, as for the turbine housing, it is preferred that the wall portion between the arc shaped outer wall thereof and the connecting part, has thin thickness or small sectional area, thereby through the part, the turbine housing can reduce transfer of heat recovering from exhaust gas, and also, such reducing can be obtained by setting a groove on the inner or outer surface of the part to narrow the heat transfer path to increase thermal resistance for example. By narrowing the heat transfer path intermittently by means of several disk shaped deep grooves on the inner surface of the part starting from the vicinity of the connecting part thereby increasing the thermal resistance of the connecting part.

According to another aspect of the present invention a covering layer made of a low heat conductive material is provided on the surface of a turbine housing of a turbocharger which is in contact with exhaust gas. The covering layer is preferably made of a low heat conductive material and more preferably made of a material with a low emissivity as well as a low heat conductiveity.

Thus, the temperature rise of a turbine housing is suppressed and therefore the heat transferred to a bearing housing from the turbine housing is reduced, leading to suppression of the temperature rise of the bearing housing.

According to a further aspect of the present invention, a turbocharger includes a covering layer made of a material with a high emissivity, which is provided on the outer peripheral surface of a turbine housing of the turbocharger. Provision of the covering layer increases the heat emissive power of the turbine housing, thus suppresses the temperature rise of the turbine housing and therefore the heat transferred to a bearing housing from the turbine housing is reduced.

Materials with a low emissivity include ceramics and heat resistant fluorescent coatings and materials with a high emissivity include graphite and oxides of soft steels (low carbon steels). These materials adhere to the surface of a turbine housing by flame spray coating or other processes, to provide a covering layer on the surface of the turbine housing.

According to still further aspect of the present invention, there is provided a turbocharger wherein a heat pipe is provided on a bearing housing to increase the cooling power and thus, suppress the temperature rise of the bearing housing. In this case, it is preferred that the vaporizing section of a heat pipe is completely welded to the bearing housing for improvement of the heat conductivity. Further, the condenser section of the heat pipe is preferred to be located as far as possible from the rotor housing and the bearing housing. The relative position of the vaporizer section and the condenser section is preferably such that the vaporizer section is lower than the condenser section, since the condensed working fluid naturally flows down and returns to the vaporizer section. It is preferred that the entire inner peripheral surface of the vaporizer section is covered with wicks and the working fluid is continually supplied to the entire inner surface of the vaporizer section due to the surface tension of fluid on the wicks.

Conventionally known heat pipes are usable as the above noted heat pipes.

According to still further aspect of the present invention, there is provided a turbocharger wherein the heat capacity of a turbine housing is 300% or less of the heat capacity of a bearing housing, to prevent the temperature of the bearing housing from rising above a predetermined level. More preferably, the total amount of the heat capacity of the turbine housing and that of the low heat conductive member is 300% or less of the heat capacity of a bearing housing. In order to reduce the heat capacity of the turbine housing, the thickness of the housing may be reduced or the material of the housing may be changed from a metal to a ceramic such as silicon nitride and silicon carbide. When a turbine housing made of cast iron with a heat capacity of 0.5 Kcal/°C. is modified to have a thinner section and be made of a ceramic material, the modified turbine housing has a heat capacity of 0.3 Kcal/°C. (the heat capacity of the turbine housing is 300% of the heat capacity of the corresponding bearing housing) and the temperature rise of the bearing housing can be 10°-15° C. lower than the temperature rise in the case where a turbine housing made of cast iron is used. This is because the sensible heat capacity transferred from the turbine housing to the bearing housing is reduced, due to the small heat capacity contained in the turbine housing just after the engine stoppage. The temperature rise of the bearing housing can be further lowered by modifiing the turbine housing having the heat capacity of less than 300%.

In the turbocharger according to the present invention, as aforementioned, an annular shaped member made of a low heat conductive material is interposed between the wall of the bearing housing and the wall of the turbine housing. However, in addition, a covering layer made of a low heat conductive material can be mounted on the inner wall surface of the turbine housing in contact with exhaust gas.

According to this turbocharger, by a covering layer mounted on the inner wall surface of the turbine housing, the heat transferred from high temperature gas passing through the inside of the turbine housing to the turbine housing can be reduced, the temperature rise of the turbine housing is suppressed, furthermore, the heat transferred from the turbine housing to the bearing housing can be reduced by means of a annular shaped member made of a low heat conductive material interposed between both walls. Accordingly, by thermo-isolating of the covering layer mounted on the inner wall surface of the turbine housing and by the heat transfer reducing effect of the annular shaped member mounted between the wall of the turbine housing and the wall of the bearing housing, the heat transferred from the wall of the turbine housing to the wall of the bearing housing can be more reduced.

And also, in the turbocharger according to the present invention, as above mentioned, an annular shaped member made of a low heat conductive material is interposed between the wall of the turbine housing and the wall of the bearing housing, and, in addition, a covering layer made of high emissive material can be mounted on the outer periphery surface of the turbine housing.

According to this turbocharger, by the layer of a high emissivity mounted on the outer periphery surface of the turbine housing, heat radiation of the turbine housing is increased, the temperature rise of the turbine housing is suppressed, and further, the heat transferred from the turbine housing to the bearing housing can be reduced by the annular shaped member of low heat conductivity mounted between said walls. Accordingly, by multiple effects of the covering layer of high emissivity having heat radiation effect mounted on the outer periphery surface and of the annular shaped member having heat transfer reducing effect mounted between the wall of the turbine housing and the wall of the bearing housing, the heat transferred from the wall of the turbine housing to the wall of the bearing housing can be more reduced.

In the above mentioned turbocharger according to the present invention, in which an annular shaped member of high heat conductivity is interposed between the wall of the turbine housing and the wall of the bearing housing, and in addition, a covering layer of high emissivity is mounted on the outer periphery surface of the turbine housing if the, radiation effect by the high emissivity covering layer is so remarkable that its influence on the efficiency of the turbocharger is feared, a covering layer of low heat conductivity may be provided on the inner wall surface of the turbine housing in contact with exhaust gas.

For further reducing the heat transferred from the wall of the turbine housing to the wall of the bearing housing, a forced cooling means such as a heat pipe, etc. which is interposed at a connecting part positioned between the wall of the bearing housing and the wall of the turbine housing or its vicinity to cool the part forcibly is combined with, a sensible heat reducing means to reduce the turbine housing's heat capacity in a specified value to the bearing housing heat capacity whereby the heat transferred from the wall of the turbine housing to the wall of the bearing housing is more reduced.

EMBODIMENT 1

Figure 2:
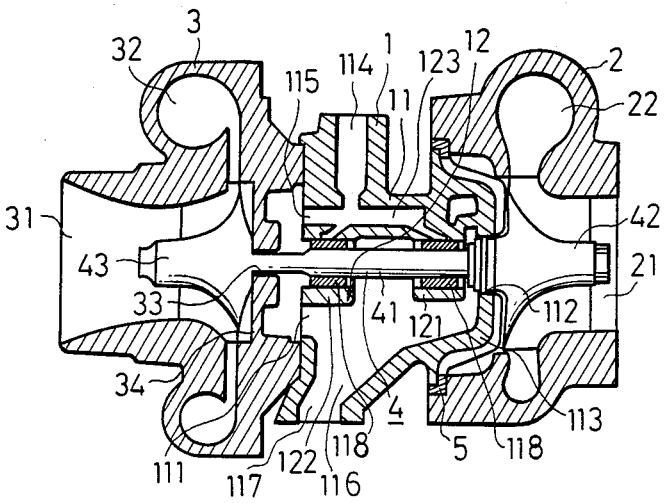
FIG. 2 is a cross-sectional view of a turbocharger according to the first embodiment of the present invention.

A turbocharger shown in FIG. 2 is an embodiment of the first aspect of the present invention.

The turbocharger comprises a bearing housing 1 situated at the center, a turbine housing 2 fixed at one end of the bearing housing 1, a compressor housing 3 fixed at the other end of the bearing housing 1, a rotor 4 rotatably supported by the bearing housing 1 and a low heat conductive member 5 provided between the bearing housing 1 and turbine housing 2. The bearing housing 1, made of cast iron, comprises a can-shaped periphery 11, having an opening 111 at one end, a flange 113 with a central opening 112 at the other end and a projected portion 12 extruding towards the center from a part of the inner wall of the periphery 11. Two bearing supports 121, 122 are coaxially provided on the both sides of the projected portion 12 and a passage 123 for supply of lubricating oil to the bearing supports 121, 122 is formed within the projected portion 12.

Figure 3:
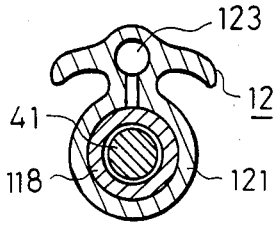
FIG. 3 is a partial cross-sectional view of a bearing 12 in FIG. 2.

The inlet of the passage 123 is an opening 114 provided in the side wall of the periphery 11 and the outlet of the passage 123 is an opening 115 provided in the side of the opening 111 of the periphery 11. In addition, a space 116 surrounded by the periphery 11 forms a reservoir of lubricating oil, which is drained through an opening 117 provided on the lower side wall of the periphery 11. The bearing supports 121, 122, as shown in FIG. 3 by the partially sectional view of the bearing support 121, are provided with each through hole which is coaxial with each other. Within each the through hole, a fully floating bearing 118 is supported, and the shaft 41 of the rotor 4 is further supported by the floating bearing 118.

The cylindrical turbine housing 2 is made of nodular graphite cast iron and has a central opening 21 in the center and a circular passage 22 with a gradually decreasing section of snail shell shape in the periphery. The central opening 21 is connected to the circular passage 22 surrounding the opening 21 through a narrow neck around the entire periphery of the opening 21. One open end of the turbine housing 2 is fixed to the flange 113 of the bearing housing 1 with bolts (not shown) via a low heat conductive member 5.

The compressor housing 3, with a shape similar to the turbine housing 2, has a central opening 31 and a circular passage 32 surrounding the opening 31. One end of the opening 31 forms a base which has a central axis 33.

The rotor 4 comprises a shaft 41 made of a nickel chrome molybdenum steel (a structural alloy steel), a turbine 42 made of a nickel chrome molybdenum steel (a structural alloy steel) fixed to one end of the shaft 41 and a compressor 43, made of an aluminum alloy fixed to the other end of the shaft 41.

The shaft 41 penetrates through the central opening 112 of the flange 113 of the bearing housing 1, is rotatably mounted on the bearing supports 121, 122 and penetrates through the central axis hole 33 of the compressor housing 3. The turbine 42 is fixed at one end of the shaft 41 and provided in the central opening 21 of the turbine housing 2. The compressor 43 is fixed at the other end of the shaft 41 and disposed in the central opening 31 of the compressor housing 3.

The low heat conductive member 5 is made of a ceramic sheet and has a ring shape with a thickness of 1 mm, wherein the periphery protrudes in the direction along the shaft 41. The heat conductivity resistance of the low heat conductive member 5 is 0.001 $m^2h°C./Kcal$.

The turbocharger according to the present embodiment has the construction described above. In the turbocharger, high temperature and high pressure exhaust gas sent from an exhaust port (not shown) of an internal combustion engine is introduced into the circular passage 22 of the turbine housing 2 and vented into the central opening 21 through a neck-like nozzle provided in the inner periphery of the circular passage 22. The ejection force of the exhaust gas, applied to the turbine 42, makes the turbine 42 rotate. The rotation of the turbine 42 is conveyed through the shaft 41 to rotate the compressor 43. Air is supplied through the central opening 31 of the compressor housing 3, where air is compressed by the compressor 43 and sent under pressure to the circular passage 32, from which air is further sent to a combustion chamber (not shown) of an internal combustion engine.

In the turbocharger according to the present embodiment, a low heat conductive member 5 is provided between the bearing housing 1 and the turbine housing 2 the heat conductivity resistance thereof being set to 0.001 $m^2h°C./kcal$. Therefore, the heat transferred from the turbine housing 2 to the bearing housing 1 can be reduced sufficiently. Thus, if an internal combustion engine operating at high loads is suddenly stopped without previous idling and cooling of the bearing housing 1 and the shaft 41 of the rotor 4 by lubricating oil is eased, the temperature rise of the bearing housing 1 itself is suppressed and no thermal decomposition and subsequent carbonization of lubricating oil will occur in the bearing parts 121, 122.

EMBODIMENT 2

Figure 4:
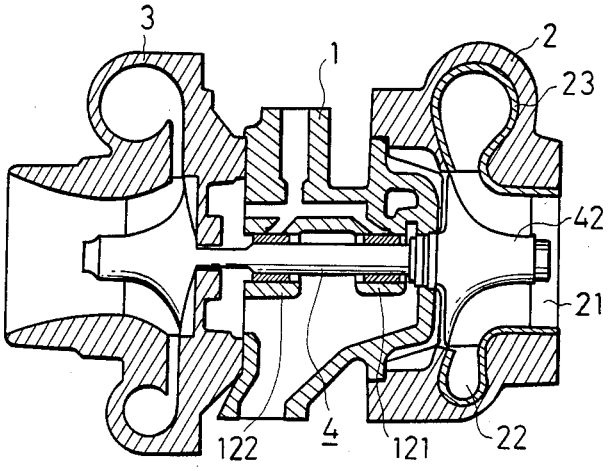
FIG. 4 is a cross-sectional view of a turbocharger according to the second embodiment of the present invention.

FIG. 4 is a sectional view of the turbocharger according to the second embodiment. The turbocharger comprises almost the same components as the turbocharger of the first embodiment. What is different is a covering layer 23 made of a low emissivity, formed on the internal surface defining a central opening 21 in contact with exhaust gas and a circular passage 22. The covering layer 23 reduces the heat transferred from the exhaust gas to the turbine housing 2 and thus the temperature rise of the turbine housing 2 itself is suppressed. Finally, the temperature rise of bearing supports 121, 122 of a bearing housing 1 is suppressed.

EMBODIMENT 3

Figure 5:
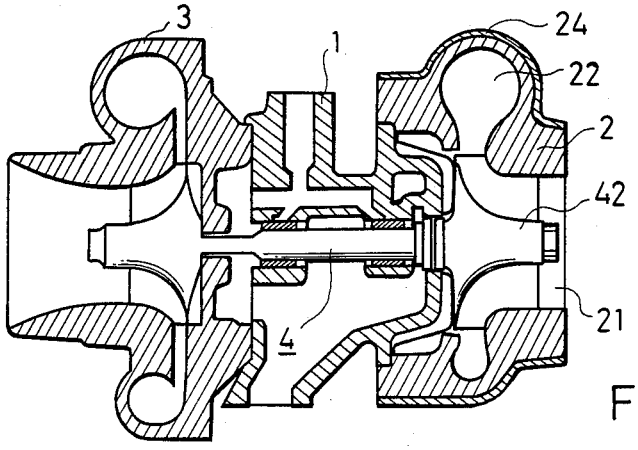
FIG. 5 is a cross-sectional view of a turbocharger according to the third embodiment of the present invention.

FIG. 5 shows a sectional view of the turbocharger according to the third embodiment of the present invention. The turbocharger comprises mostly the same components as the turbocharger according to the first embodiment. In this embodiment, a covering layer 24 made of a high emissivity is formed on the external peripheries of the turbine housing 2. The covering layer 24 has a role to provide a high emissivity effect and suppresses the temperature rise of the turbine housing 2. Thus, the temperature rise of the bearing housing 1 is reduced.

EMBODIMENT 4

Figure 6:
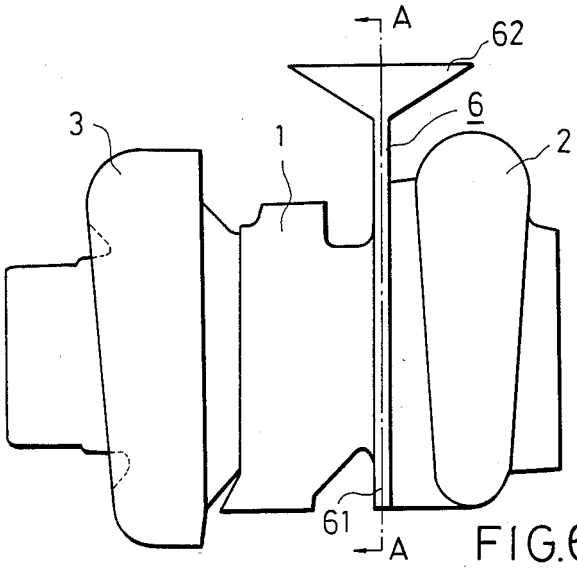
FIG. 6 and FIG. 7 show a turbocharger according to the fourth embodiment of the present invention.
Figure 7:
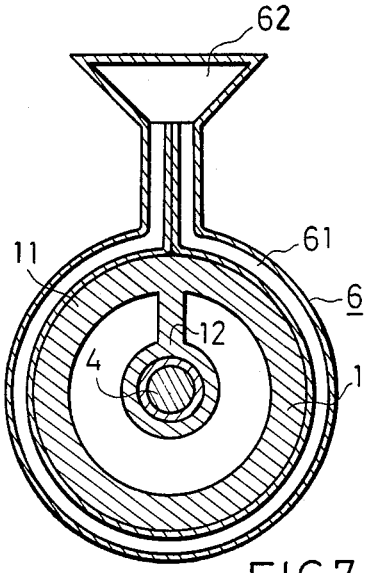

FIG. 6 is a side elevation of a turbocharger of the fourth embodiment of the present invention and FIG. 7 is a sectional view along A—A line in FIG. 6. The body of the turbocharger is the same as that of the first embodiment. In this embodiment, the vaporizer part 61 of a heat pipe 6 is integrally welded to the side periphery of the bearing housing 1 near the turbine housing 2 and the condenser part 62 of the heat pipe 6 is provided on the top of the turbocharger. Wicks are set on the inner periphery of the vaporizer part 61 of the heat pipe 6 and the heat pipe 6 itself has an air-tight construction, in which a working fluid is charged under a vacuum pressure. In this heat pipe 6 like a conventional heat pipe, the working fluid in the vaporizer part 61 evaporates by the heat from the bearing housing 1 and moves to the condenser part 62, where the working fluid is cooled to condense. The liquefied working fluid flows down by gravity to return to the vaporizer part 61. Thus, the bearing housing 1 is directly cooled and the temperature rise thereof is suppressed.

EMBODIMENT 5

Figure 8:
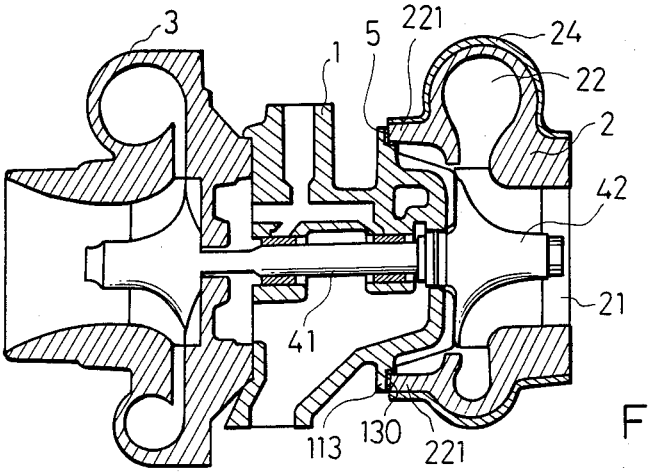
FIG. 8 is a cross-sectional view of a turbocharger according to the fifth embodiment of the present invention.

FIG. 8 shows a sectional view of the turbocharger of the fifth embodiment according to the present invention.

The fifth embodiment is characterized by that firstly, the connecting part between the bearing housing 1 and the turbine housing 2 has an annular member 5 made of low heat conductive material; secondly, an extruded portion which constitutes the connecting part of the turbine housing is thin in thickness, while the connecting part of the bearing housing forms a caved shape; thirdly, the wall part between the arc shaped outer wall of the turbocharger and the connecting part is thin in thickness, and fourthly, a covering layer made of high emissive material is mounted on the outer perhiphery surface of the turbine housing.

Particularly, a narrow extruded (or convex) portion 221 is formed at an open end of the turbine housing 2, making such vicinity of the open end thinner, and also, at the flange part 113 of the bearing housing 1, a caved (or convex) portion 130 with steps corresponding to the aforementioned extruded portion 221 is formed, and the extruded portion 221 of the turbine housing 2 is connected with the caved portion 130 via an annular shaped member 5 whose end face is made of a low heat conductive material and the both (not shown in the drawing) are fixed with bolts.

The annular shaped member 5 is of L shape is and made of ceramic fiber of 1.5 mm thick and ring shape.

According to the fifth embodiment, there is a covering layer made of a highly emissive material on the outer periphery of the turbine housing, and the heat radiation of the outer wall of the turbine housing, is carried out effectively, so the sensible heat of the turbine housing can be reduced.

Further owing to the reduced thickness of the wall parts the heat transfer of the parts, can be decreased. Furthermore, since the extruded portion of the turbine housing is reduced in thickness, and the connecting part of the bearing housing is a caved shape, the heat transfer of said part can be reduced. Further, interposition of an annular member made of ceramic fiber at the connecting part between the bearing housing and turbine housing leads to further reduction of the heat transferred from the wall of the turbine housing to the wall of the bearing housing.

From aforementioned, in this case, effects of each thermo-reducing means collectively act, thereby the heat transferred from the wall of the turbine housing to the wall of the turbine housing to the wall of the bearing housing can be more reduced.

What is claimed is:

1. A turbocharger comprising a turbine rotor, a bearing housing having a connecting portion and supporting a shaft of the turbine rotor and acting as a lubricating means, a turbine housing having a connecting portion through which it is fixed to said connecting portion of said bearing housing and mounting the turbine of the turbine rotor, a compressor provided at the other end of said bearing housing, and an annular member provided between said connecting portion of said turbine housing and said connecting portion of said bearing housing for reducing the heat to be transmitted by heat conduction from said connecting portion of said turbine housing to said connecting portion of said bearing housing, said annular member being made of a high heat conductivity resistant material having a heat transfer resistance of higher than about 0.001 "$m^2h°C./Kcal$"

the connection portion of the turbine housing and the connecting portion of the bearing housing being the sole portions of those elements which would contact each other in the absence of the annular member which separates them.

2. A turbocharger according to claim 1, wherein said connecting portion of said turbine housing is an annular concave portion, said connecting portion of said bearing housing is an annular convex portion and said annular member is provided between said concave and said convex portions.

3. A turbocharger according to claim 2, wherein said concave portion of said turbine housing is of a reduced thickness for reducing heat transfer from said turbine housing to said bearing housing.

4. A turbocharger according to claim 1, wherein said connecting portion of said turbine housing is an annular convex portion, said bearing housing is an annular concave portion and said annular member is provided between said convex and said concave portions.

5. A turbocharger according to claim 4, wherein said concave portion of said bearing housing is of a reduced thickness for reducing heat transfer from said turbine housing to bearing housing.

6. A turbocharger according to claim 5, wherein said annular member is formed of a material selected from the group consisting of laminated intercalated minerals and ceramic fibers.

7. A turbocharger according to claim 6, wherein said ceramic fiber is glass fiber.

8. A turbocharger according to claim 7, wherein said ceramic fiber is zirconia fiber.

9. A turbocharger according to claim 1, further comprising a sensible heat reducing means to reduce the sensible heat of said turbine housing.

10. A turbocharger according to claim 9, wherein said sensible heat reducing means comprises a surface layer made of a low heat conductive material on the inner surface of said turbine housing for reducing the heat transmitted to said turbine housing.

11. A turbocharger according to claim 10, wherein said low heat conductive material is selected from the group consisting of ceramics and heat resisting fluorescent material.

12. A turbocharger according to claim 9, wherein said sensible heat reducing means is a layer made of a highly emissive material for increasing emissive power of said turbine housing, said layer being provided on the outer surface of said turbine housing for radiating the heat of said turbine housing to be cooled.

13. A turbocharger according to claim 12, wherein said highly emissive material is one selected from the group consisting of graphite and an oxide of a low carbon steel.

14. A turbocharger according to claim 9, wherein said turbine housing itself has a smaller heat capacity than that of said bearing housing.

15. A turbocharger according to claim 14, wherein the heat capacity of said turbine housing is less than three times the heat capacity of said bearing housing.

16. A turbocharger according to claim 1, further comprising a forcible cooling means for reducing the heat transmitted by heat conduction from said turbine housing to said bearing housing.

17. A turbocharger according to claim 16, wherein said forcible cooling means is a heat pipe which comprises an annular evaporator fixed around the boundary of said turbine housing and said bearing housing as a condenser connected tightly to said evaporator and situated apart from said turbine housing and said bearing housing.

18. A turbocharger according to claim 17, wherein said evaporator is formed integrally with said bearing housing.

19. A turbocharger according to claim 2, wherein said convex portion of said bearing housing is of a reduced thickness for reducing heat transfer from said turbine housing to said bearing housing.

20. A turbocharger according to claim 4, wherein said convex portion of said turbine housing is of a reduced thickness for reducing heat transfer from said turbine housing to said bearing housing.

* * * * *